US008904676B2

(12) United States Patent
Clasen et al.

(10) Patent No.: US 8,904,676 B2
(45) Date of Patent: Dec. 9, 2014

(54) UNDERCUTTER DEVICE

(75) Inventors: Dennis Clasen, Wamego, KS (US); Scott Balderson, Wamego, KS (US); Harold Fechter, Bellevue, KS (US)

(73) Assignee: Dymax, Inc, Wamego, KS (US)

( * ) Notice: Subject to any disclaimer, the term of this patent is extended or adjusted under 35 U.S.C. 154(b) by 0 days.

(21) Appl. No.: 12/576,223

(22) Filed: Oct. 8, 2009

(65) Prior Publication Data

US 2011/0083346 A1 Apr. 14, 2011

(51) Int. Cl.
*E01B 27/00* (2006.01)
*E01B 27/04* (2006.01)
*E02F 3/14* (2006.01)

(52) U.S. Cl.
CPC ..... *E02F 3/146* (2013.01); *E01B 27/04* (2013.01)
USPC ..... 37/104

(58) Field of Classification Search
USPC ..... 37/104, 352–357, 362, 366, 367, 386, 37/387, 462–466; 299/39.1, 39.4, 299/39.7–39.9, 67, 76, 78; 404/90, 91; 198/837, 841, 635, 728; 474/140; 460/16
See application file for complete search history.

(56) References Cited

U.S. PATENT DOCUMENTS

| | | | | |
|---|---|---|---|---|
| 2,488,343 | A | 11/1949 | Standal | |
| 2,866,538 | A * | 12/1958 | Goldberg | 198/841 |
| 2,948,309 | A | 4/1960 | Hoff et al. | |
| 2,962,061 | A | 11/1960 | Nielsen et al. | |
| 3,315,384 | A | 4/1967 | Weyers | |
| 3,436,848 | A | 4/1969 | Peppin | |
| 3,457,660 | A | 7/1969 | Speno | |
| 3,967,395 | A | 7/1976 | Stuart | |
| 3,967,396 | A | 7/1976 | Maisonneuve | |
| 4,119,154 | A | 10/1978 | Miller | |
| 4,253,256 | A | 3/1981 | Feliz | |
| 4,355,687 | A | 10/1982 | Theurer | |
| 4,563,826 | A | 1/1986 | Whitaker, Jr. | |
| 4,674,208 | A | 6/1987 | Whitaker, Jr. | |
| 4,775,189 | A * | 10/1988 | Den Besten | 299/82.1 |
| 4,858,344 | A | 8/1989 | Cotsford | |
| 4,882,860 | A | 11/1989 | Whitaker, Jr. | |
| 5,029,649 | A | 7/1991 | Kershaw et al. | |
| 5,271,166 | A | 12/1993 | Theurer | |
| 5,988,363 | A * | 11/1999 | Takahashi et al. | 198/841 |
| 6,054,671 | A | 4/2000 | Shelton et al. | |
| 6,862,822 | B1 | 3/2005 | Masse | |
| 6,968,942 | B2 * | 11/2005 | Linder | 198/841 |
| 7,290,360 | B2 * | 11/2007 | Unzicker et al. | 37/352 |
| 7,481,168 | B2 | 1/2009 | Pike et al. | |
| 2006/0096131 | A1 | 5/2006 | Hall | |

FOREIGN PATENT DOCUMENTS

| | | | |
|---|---|---|---|
| IT | WO 96/06979 | A1 | 3/1996 |

* cited by examiner

*Primary Examiner* — Robert Pezzuto
(74) *Attorney, Agent, or Firm* — Bruce J. Clark

(57) ABSTRACT

An undercutter attachable to utility machines has a bar with chain having teeth for cutting into rock beds, whereby the chain rotates about the bar. The bar has removable top and bottom portions, which when in place and secured, provide a channel for the chain, and when the top and bottom portions are removed, allow for replacement of worn parts without loosening or removing the chain.

15 Claims, 4 Drawing Sheets

UNDERCUTTER DEVICE

BACKGROUND OF THE INVENTION

This invention relates to the field of undercutters. Undercutters are used to scoop out contaminated gravel from beneath railroad tracks. These devices employ a chain mechanism pulled by drives means around an elongated bar in a manner similar to that of a chain saw. An undercutter however utilizes a much larger chain and cutting mechanism, and exists in an extremely abrasive environment. Thus, by its nature the chain is extremely heavy, several hundred pounds, requiring two or more men to lift and remove it to gain access to the bar for replacement, and difficult to do in the field without lifting equipment. In particular, after a certain number of hours, certain parts of the bar wear out and need replacing, requiring the machine be shut down for time consuming, burdensome and difficult removal of the chain so as to allow access to the bar for replacement or maintenance of parts. Regardless of whether it's an off the track undercutter or on track undercutter, the chain has to be loosened, removed or disassembled.

It is therefore desirable to have easily replaceable parts. The removal of the chain is a significant requirement in the prior art and results in considerable down time when the machine is out of commission. If replacement parts were such that removal of the chain were unnecessary, then considerable time, expense, labor and likelihood of injury is significantly reduced, resulting in more work time available for the machine as well. It is estimated that given the device often requires maintenance every several hundred hours that thousands of dollars can be saved if the chain need not be removed during this type of maintenance. Moreover, the chain tends to wear parts of the bar more in some areas than others. For example, the cutting face of the bar (facing the material being cut into) tends to wear faster because of the additional pressure on the chain and bar at the cutting face side.

Prior art discloses a removable C-channel segment within which the chain rides and is guided, however replacement of these worn parts requires actual removal of the chain; moreover, the entire C-channel is primarily unusable and needs replaced. The invention provides part that, because only portions are worn, can continue to be used by reversing, rotating, flipping and/or interchanging. While this alone is important, the ability to do so without removing or loosening the chain is significant. It also allows for targeted maintenance, to relatively quickly change a discreet particularly over worn section. In other words, if one has to remove the chain, with the difficulties described above, one may as well replace more, if not all, parts while doing so. This is not the case with the invention, as only those fully worn parts need be replaced or changed.

The invention comprises a set of bolted on pieces on top and on the bottom in a manner that provides the chain guide channel while maintaining structural strength, that allows for easy targeted removal, by removing the bar top and bottom while the chain remains essentially in place. The bar need not be replaced, nor is it necessary to remove, or even loosen, the chain. Moreover, the parts most worn, for example those on the cutting face side, can still be used by flipping them, reversing them, rotating them, or interchanging them to the backside or elsewhere, to utilize unworn portions of the segment. These parts, smaller and less expensive from the start, can now have double the life span compared to those in the prior art. Still further, these parts typically get fully worn before discarding. Furthermore, the bar parts are expensive and heavy (up to a hundred pounds each) and the planar nature lends the parts to be refurbished and recycled by grinding down and recoating.

It is therefore an object of the invention to create an undercutter device that allows for easy maintenance of the bar and parts related to it without removing the chain, and to allow reusing interchangeable parts. It is also an object to provide an easily maintained bar structure for the undercutter that is safer to maintain and minimizes the possibility of injury that is inherent when removing a several hundred pound chain that also allows for less downtime of the machine during maintenance and thus more profitable use of the machine. Other features and objects will be apparent from the disclosure herein.

DESCRIPTION OF THE PREFERRED EMBODIMENTS

Figure 1:
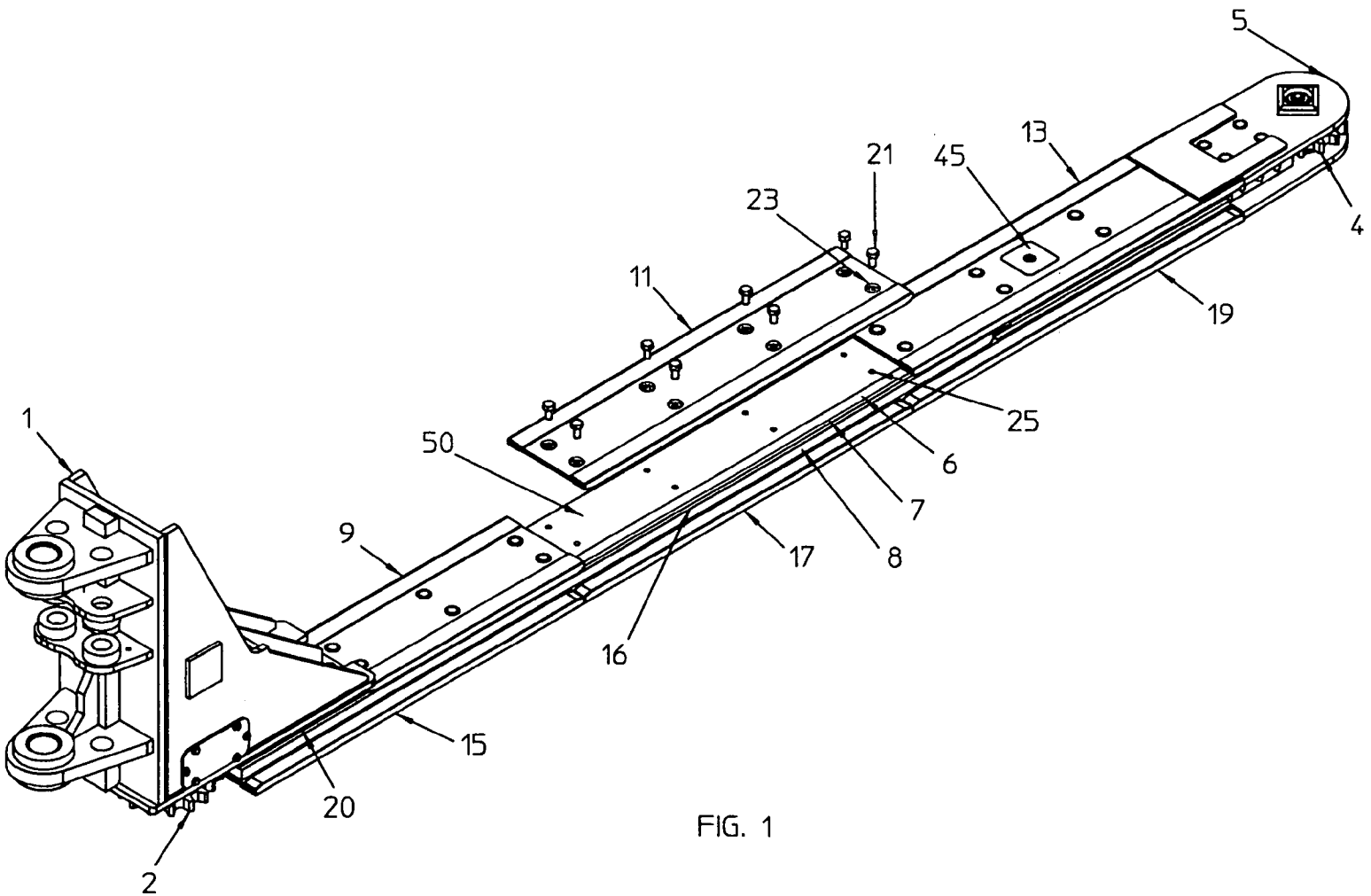
FIG. 1 shows the undercutter bar invention in a semi exploded view.
Figure 2:
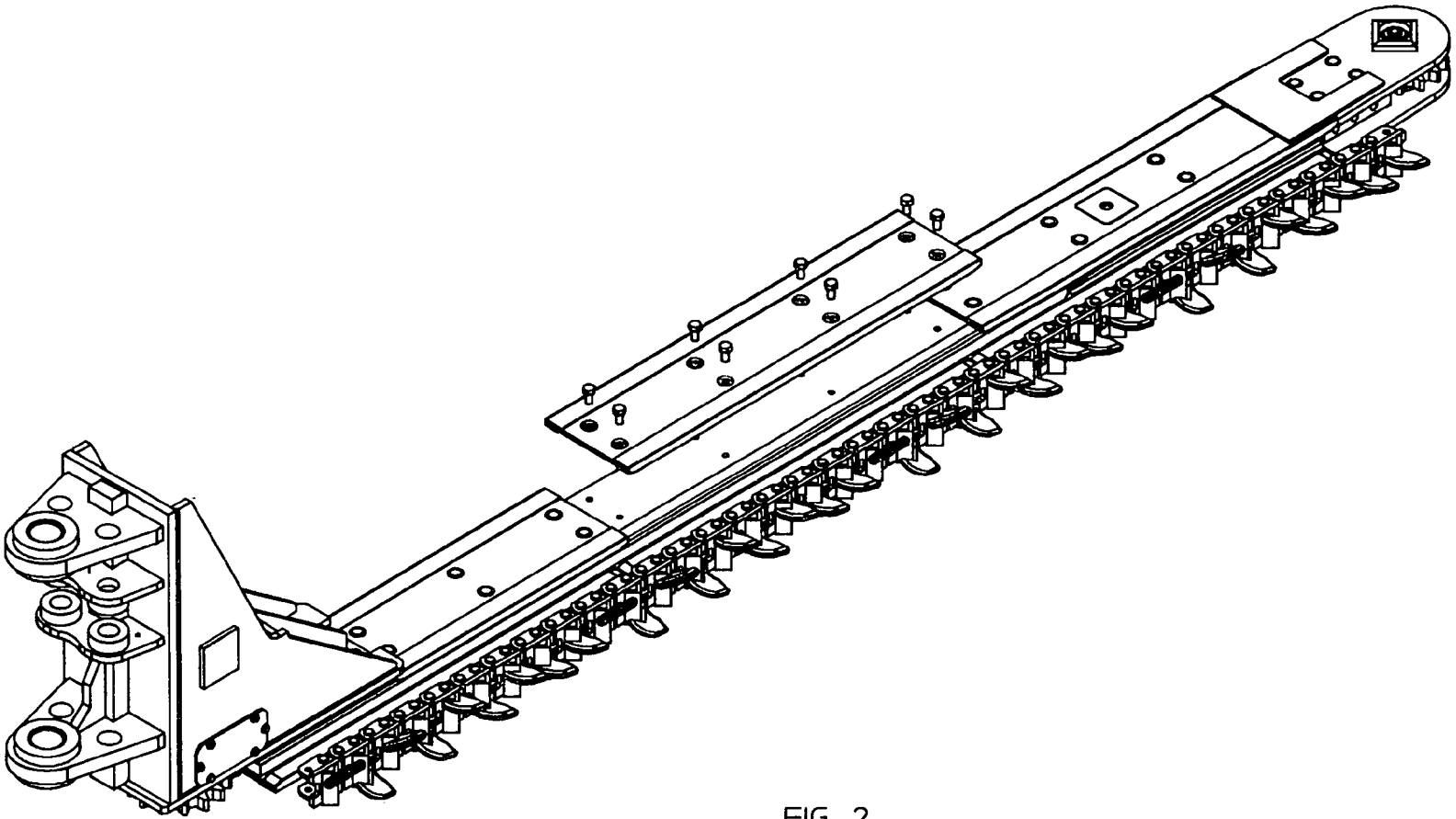
FIG. 2 shows the undercutter bar invention as in FIG. 1, but with the chain in place.

The invention is shown in a semi exploded form without the chain in FIG. 1. The base 1 has affixed to it the bar having a base end near the base 1 and an opposite distal end 5. Sprockets 2 and 5 near each end provide the chain guiding and moving means. The chain is shown on the bar in FIG. 2.

Figure 4:
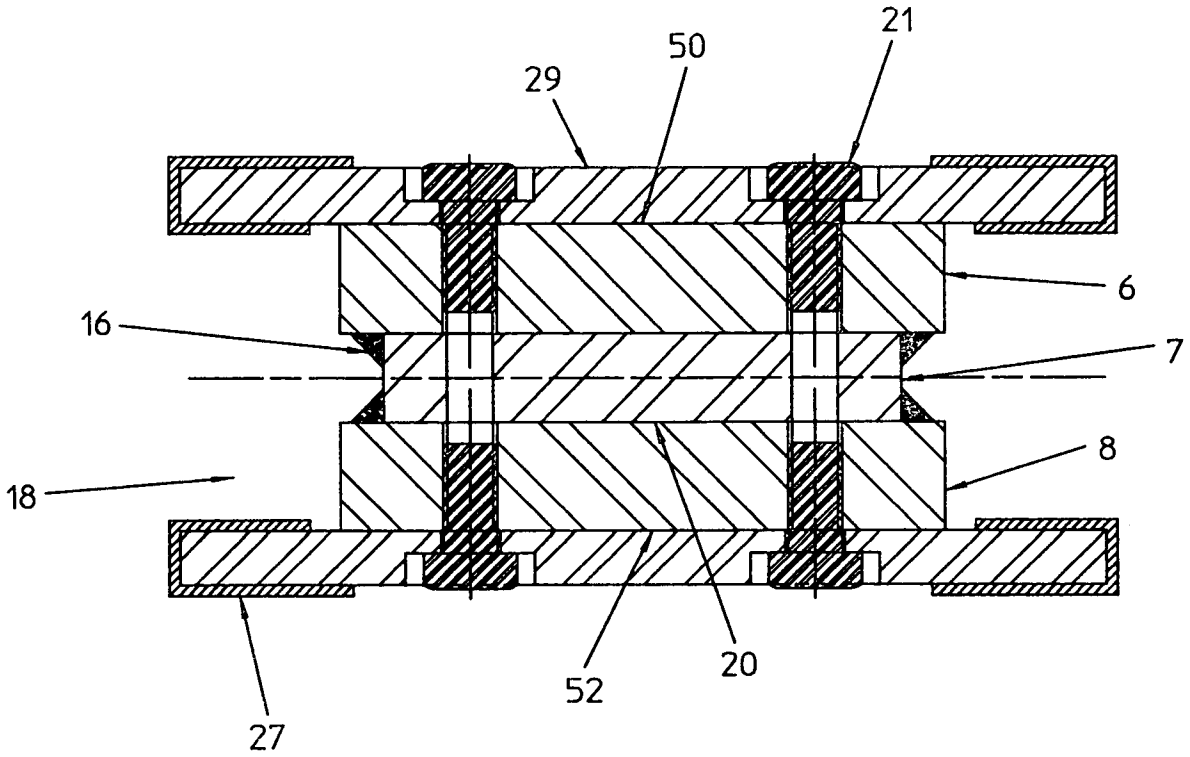
FIG. 4 shows the end view of the bar of the invention.

The bar 10, in the preferred embodiment, has a central main bar 20 being an elongated rigid member. One method to create has at least three elongated members welded together, two outer members 6 and 8 and at least one middle member 7 in FIG. 4. The middle member is recessed in at least one part so as to allow the primarily inside placement of the weld or welds at 16 so as they do not extend meaningfully into the channel 18.

A main channel 18 is created having a removable top portion and/or a removable bottom portion. In the preferred mode, a plurality (two or more) of top segments 9, 11, and 13 will form the top of the bar and create the top of the main channel 18 (FIG. 4*a*) within which the chain will move, while a plurality of segments 15, 17 and 19 form the bottom of said channel.

These segments 9, 11, 13, 15, 17, and 19 are rigid pieces each having two ends and having means for removably attaching them to the central main bar 20 at a top face 50 of the main bar and to the bottom face 52 of the main bar. In the preferred mode, there are three segments on top, essentially end to end, each similar to segment 11 but not necessarily of the same length, and each having holes 23 therein through which bolts 21 are used to secure them to the central main bar in the threaded holes 25. The holes are drilled and/or placed so as to allow the segment to be flipped in place and bolted from either side to further extend the useful life of the segment.

It is preferred that as many of the segments as possible be of uniform length and size. Standard undercutting mechanisms require that the bottom segments extend further toward the base than does the top. In the preferred mode, there are at least two segments that are interchangeable, and as shown, five segments 11, 13, 15, 17, 19 are of the same length. Only segment 9 is shorter. Moreover, segment 13 and 19 have therein access means 45 to gain access to the chain adjustment mechanism within the main bar. This access means 45 is comprised of a removable plug in each segment 13 and 19, held in place by one elongated bolt and nut. To make all five segments interchangeable, each can have the same hole manufactured therein for receiving plug means 45.

Interchangeable as used here means that one plate can fit in more than one place. The segments are also reversible. Reversible means rotating without turning the segment over. The segments are also flippable in place, which means the segment can be turned over and used.

The ends of each segment have means on at least one side to allow for easy chain movement across the faces and edged of the segments without interference or catching. In the preferred mode, these are beveling means 55 in FIG. 3. These beveling means will also be created on the opposite side at 60 of the segment if the segment is to be made flippable in place. 'Beveling means' refers to any slant or gradual decrease in thickness towards the ends 9 and 40 of the segment.

Figure 3:
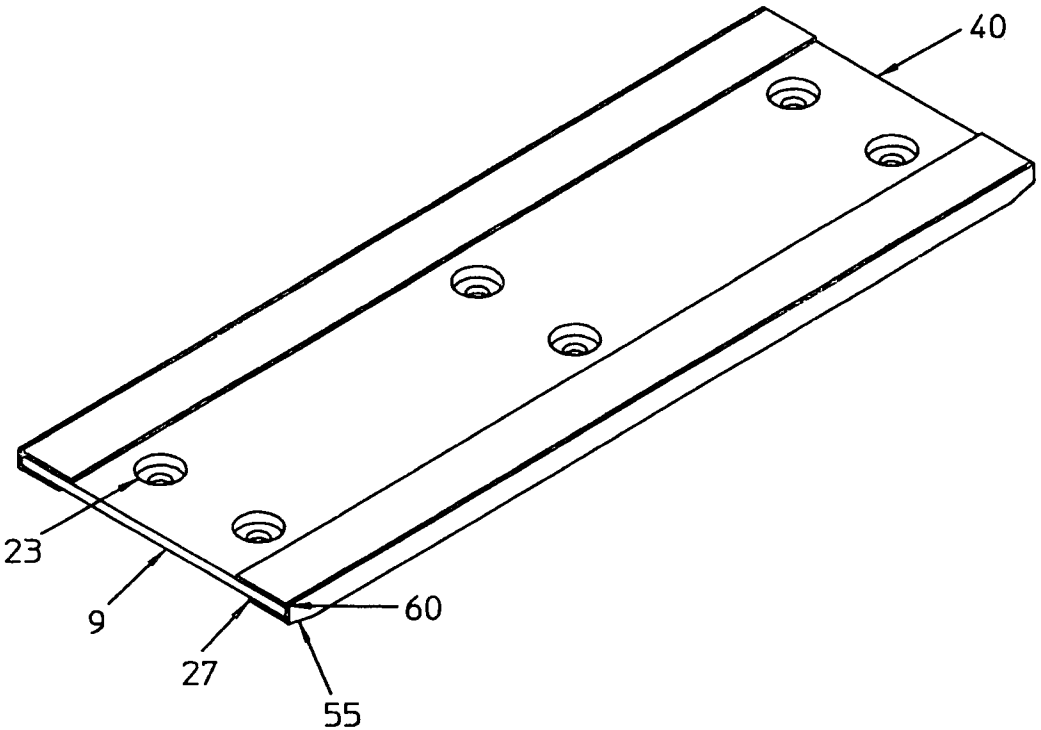
FIG. 3 shows one of the top pieces.

The typical segment is further shown in the preferred mode in FIG. 3 having, representative hole 23, and further having chrome carbide overlay added to provide resistance to the wear and tear of the chain movement over time. It is these segments that primarily become worn and will be replaced, rather than the entire bar. As discussed, the prior art bar generally would need replacing entirely, or at least major sections if it contains C-Channel segments.

The top and bottom segments, when bolted securely to the central main bar in the manner shown, create an elongated rigid member having targeted easily replaceable and reusable wear parts. Moreover, the planar shape lends to recycling and refurbishing the parts.

In use, when the chain eventually wears the channel, which should occur primarily on the top and bottom segments, the segments are removed by simply unscrewing the bolts, without the need to remove or even loosen the chain. The segments can be totally replaced as needed, however, it will be seen that the segments can be created with holes placed and formed so as to be interchangeable with one or most other segments, even reversible, to allow them to be reversed, or moved to another location, where their unworn portion can be exposed to the chain wear, as if an entirely new segment were there, thus allowing reusing the segments until the entire segment is worn, even further reducing the costs.

What is shown is a convenient easy to use and undercutter that is much easier to maintain, cheaper to maintain, and more efficient and productive.

What is claimed is:

1. An undercutter comprised of an elongated bar having a chain guide channel for guiding a continuous chain, first rotatable sprocket means attached to the elongated bar, a continuous chain having attached teeth for cutting and removing material and revolving around the elongated bar and second rotatable sprocket means in the chain guide channel, drive means for moving the continuous chain, wherein said elongated bar is comprised of an elongated middle rigid bar member having two ends being a distal end and a base end and having a top face and a bottom face in between the two ends, a top rigid member attached to the top face, a bottom rigid member attached to the bottom face, wherein the top rigid member and bottom rigid member in combination with the middle rigid bar member together create the chain guide channel between the top rigid member and bottom rigid member, and wherein at least one of the top rigid member and bottom rigid member is removably attached to the middle rigid bar member, and wherein said undercutter has means for attaching the undercutter to an external device, said external device having means for positioning the undercutter in desired positions during use.

2. The undercutter in claim 1 wherein at least one of the top and bottom rigid members is comprised of at least two rigid segments each of said rigid segments having two opposing ends, and each rigid segment having means for removably attaching each rigid segment to the middle rigid bar member.

3. The undercutter in claim 1 wherein the top rigid member and bottom rigid member is comprised of a plurality of rigid segments with means for removably attaching said rigid segments to the middle rigid bar member.

4. The undercutter in claim 2 wherein the rigid segments have wear resistant means affixed to resist wear from the continuous chain.

5. The undercutter in claim 3 wherein the rigid segments have wear resistant means affixed to resist wear from the continuous chain.

6. The undercutter in claim 4 wherein the resistant means are comprised of a chrome carbide overlay.

7. The undercutter in claim 5 wherein the resistant means are comprised of a chrome carbide overlay.

8. The undercutter in claim 2, 3, 4, 5, 6, or 7, wherein the rigid segments are reversible.

9. The undercutter in claim 2, 3, 4, 5, 6, or 7 wherein at least two of the rigid segments are interchangeable.

10. The undercutter in claim 2, 3, 4, 5, 6, or 7 wherein at least one of the rigid segments is flippable.

11. The undercutter in claim 2, 3, 4, 5, 6, or 7 wherein at least two rigid segments are reversible, interchangeable and flippable.

12. The undercutter in claim 2 wherein the ends of each rigid segment have means for preventing said ends from interfering with the chain movement.

13. The undercutter in claim 3 wherein the ends of each rigid segment have means for preventing said ends from interfering with the chain movement.

14. The undercutter in claim 12 or 13 wherein the means for preventing the continuous chain from interfering with the continuous chain movement are comprised of beveling the ends of the rigid segments.

15. An undercutter comprised of an elongated bar having a chain guide channel for guiding a continuous chain, rotatable sprocket means attached to the elongated bar, a continuous chain having attached teeth for cutting and removing material and said chain revolving around the elongated bar and sprocket means in the chain guide channel drive means for moving the continuous chain, and wherein said elongated bar is comprised of an elongated middle rigid bar member having two ends being a distal end and a base end, and a top face and bottom face in between the two ends, at least two top rigid members with means for removably attaching them to the top face, and at least two rigid bottom members with means for removably attaching them to the bottom face, wherein the top rigid members and bottom rigid members in combination with the middle rigid bar member together create the chain guide channel between the top rigid members and bottom rigid members, and wherein the top rigid members and bottom rigid members can be removed without loosening the continuous chain, and wherein said undercutter has means for attaching the undercutter to an external device, said external device having means for positioning the undercutter in desired positions during use.

* * * * *